US012710056B2

(12) United States Patent
Zilbauer et al.

(10) Patent No.: US 12,710,056 B2
(45) Date of Patent: Aug. 18, 2026

(54) THROTTLE VALVE FOR COOLANT CIRCULATION SYSTEM

(71) Applicant: Ingersoll-Rand Industrial, U.S., Inc., Davidson, NC (US)

(72) Inventors: Brian Zilbauer, Buffalo, NY (US); Thao Lai, Buffalo, NY (US)

(73) Assignee: Ingersoll-Rand Industrial, U.S., Inc., Davidson, NC (US)

( * ) Notice: Subject to any disclaimer, the term of this patent is extended or adjusted under 35 U.S.C. 154(b) by 96 days.

(21) Appl. No.: 18/214,143

(22) Filed: Jun. 26, 2023

(65) Prior Publication Data

US 2024/0003362 A1 Jan. 4, 2024

Related U.S. Application Data

(60) Provisional application No. 63/356,545, filed on Jun. 29, 2022.

(51) Int. Cl.
*F04D 29/58* (2006.01)
*F04B 25/00* (2006.01)
(Continued)

(52) U.S. Cl.
CPC ..... *F04D 29/5833* (2013.01); *F04B 25/00* (2013.01); *F04B 39/06* (2013.01);
(Continued)

(58) Field of Classification Search
CPC .. F04D 29/5826; F04D 17/12; F04D 29/5833; F04D 25/06; F04D 27/0207;
(Continued)

(56) References Cited

U.S. PATENT DOCUMENTS 3,966,362 A * 6/1976 Linhardt ..... F01D 15/08 417/244
4,362,462 A * 12/1982 Blotenberg ..... F04D 29/5833 415/179
(Continued)

FOREIGN PATENT DOCUMENTS

CN 111075695 B 1/2021
CN 214499565 † 10/2021
(Continued)

OTHER PUBLICATIONS

Extended European Search Report for Application No. 23182497.0, dated Nov. 6, 2023.
(Continued)

*Primary Examiner* — Peter J Bertheaud
(74) *Attorney, Agent, or Firm* — Kevin E. West; Advent, LLP

(57) ABSTRACT

A fluid compressor system configured to supply a compressed working fluid including at least a first air-end and a second air-end, a first and second intercooler, and a coolant circulation system having at least one throttle valve. The first and second intercoolers are configured to cool the compressed working fluid delivered by the first and second air-ends of the fluid compressor system, respectively. The coolant circulation system includes a coolant supplying header and a coolant collecting header, where the coolant supplying header supplies a coolant to the first intercooler and the second intercooler, and the coolant collecting header collects the coolant from the first intercooler and the second intercooler. The at least one throttle valve regulates a coolant flow discharged by one of the first intercooler or the second intercooler prior to entering the coolant collecting header.

17 Claims, 6 Drawing Sheets

(51) Int. Cl.

| | |
|---|---|
| ***F04B 39/06*** | (2006.01) |
| ***F04B 41/06*** | (2006.01) |
| ***F04D 15/00*** | (2006.01) |
| ***F04D 17/12*** | (2006.01) |
| ***F04D 25/06*** | (2006.01) |
| ***F04D 25/16*** | (2006.01) |
| ***F04D 27/02*** | (2006.01) |
| ***F25B 1/10*** | (2006.01) |

(52) U.S. Cl.
CPC ..... *F04B 41/06* (2013.01); *F04D 15/0005* (2013.01); *F04D 17/12* (2013.01); *F04D 25/06* (2013.01); *F04D 25/16* (2013.01); *F04D 27/0207* (2013.01); *F04D 27/0215* (2013.01); *F04D 27/0269* (2013.01); *F04D 29/5826* (2013.01); *F25B 1/10* (2013.01)

(58) Field of Classification Search
CPC .. F04D 27/0215; F04D 27/0269; F04D 25/16; F04B 41/06; F04B 25/00; F04B 39/06; F25B 1/10
See application file for complete search history.

(56) References Cited

U.S. PATENT DOCUMENTS

| | | | | |
|---|---|---|---|---|
| 4,618,310 | A * | 10/1986 | Michelson | F04D 17/12 415/129 |
| 5,613,843 | A * | 3/1997 | Tsuru | F04C 23/00 417/360 |
| 8,250,857 | B2 * | 8/2012 | Driscoll | F01N 3/208 60/303 |
| 9,702,376 | B2 * | 7/2017 | Darde | F04D 29/023 |
| 2007/0189905 | A1 | 8/2007 | Dinsdale et al. | |
| 2008/0008602 | A1 * | 1/2008 | Pozivil | F04D 29/5833 417/247 |
| 2015/0361984 | A1 | 12/2015 | Ohta et al. | |

FOREIGN PATENT DOCUMENTS

| | | | |
|---|---|---|---|
| CN | 214499565 | U | 10/2021 |
| CN | 113661325 | A | 11/2021 |
| CN | 113700628 | A | 11/2021 |
| JP | 1315690 | A2 † | 12/1989 |
| PL | 275978 | A1 | 5/1990 |
| PL | 158456 | B1 † | 9/1992 |
| WO | 22112910 | A1 † | 6/2022 |
| WO | 2022112910 | A1 | 6/2022 |

OTHER PUBLICATIONS

Communication pursuant to Rule 114(2) EPC for Application No. 23182497.0, dated Nov. 11, 2024.
Communication pursuant to Rule 114(2) EPC for Application No. 23182497.0, dated Oct. 14, 2024.
Toghraei, Moe, "Piping and Instrumentation Diagram Development," Plant Process Control, 2019, pp. 320-322, Wiley and Sons.
Communication Pursuant to Article 94(3) EPC for Application No. 23182497.0, dated Jul. 4, 2025.
First Office Action in China for Application No. 2023107849297, dated Mar. 3, 2026.

* cited by examiner
† cited by third party

THROTTLE VALVE FOR COOLANT CIRCULATION SYSTEM

BACKGROUND

Compressors increase the pressure of a compressible fluid (e.g., air, gas, etc.) by reducing the volume of the fluid. Often, compressors are staged so that the fluid is compressed several times in different stages, to further increase the discharge pressure of the fluid. As the pressure of the fluid increases, the temperature of the fluid also increases. Consequently, in some compressors, the compressed fluid may be cooled between stages.

DRAWINGS

The Detailed Description is described with reference to the accompanying figures. The use of the same reference numbers in different instances in the description and the figures may indicate similar or identical items.

DETAILED DESCRIPTION

Figure 1:
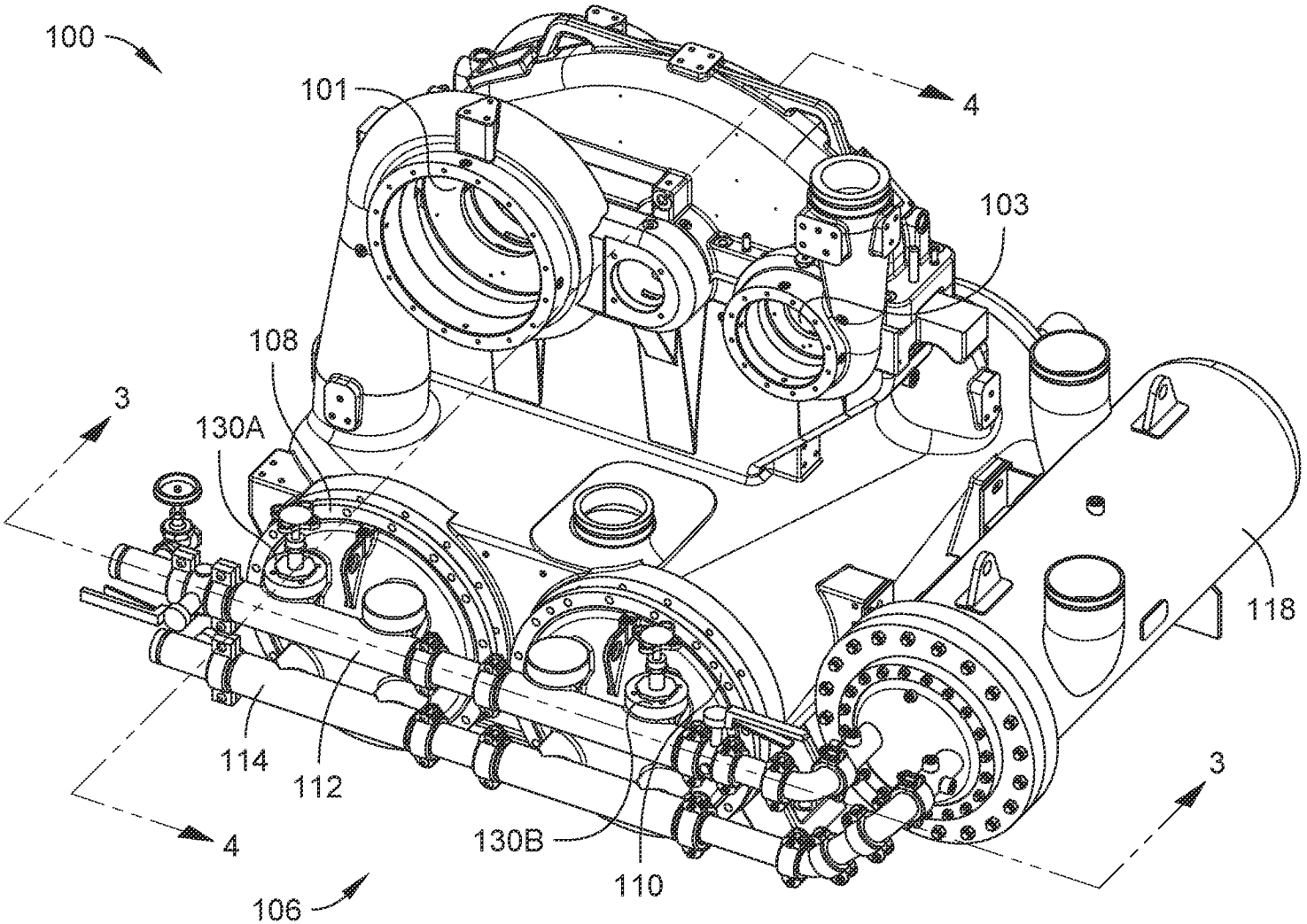
FIG. 1 is a perspective front view illustrating a fluid compressor system having a first air-end, a third air-end, a first intercooler, a second intercooler, an aftercooler, and a coolant circulation system having a coolant supplying header and a coolant collecting header in accordance with example embodiments of the present disclosure.
Figure 2:
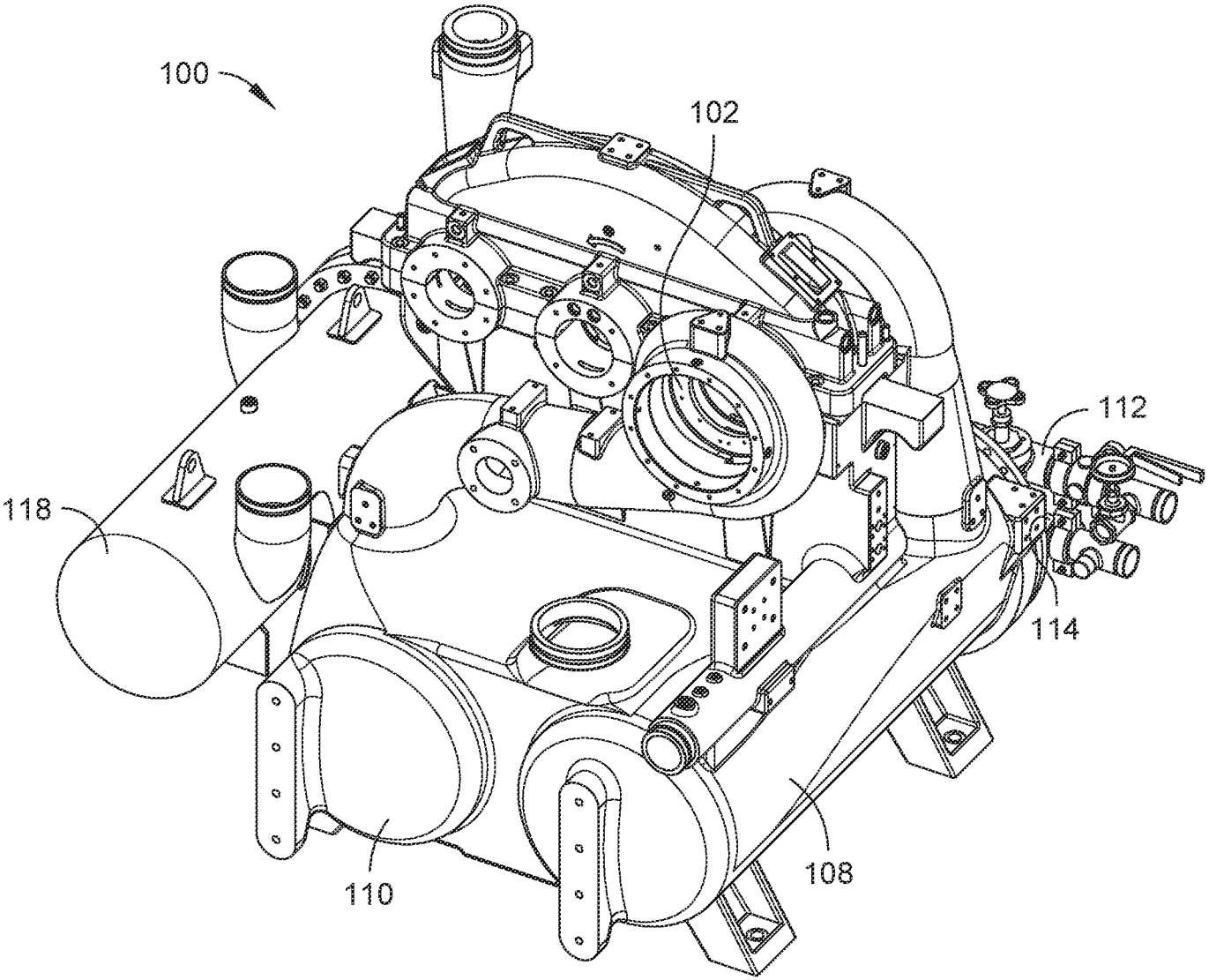
FIG. 2 is a perspective rear view illustrating the fluid compressor system shown in FIG. 1 having a second air-end, in accordance with example embodiments of the present disclosure.

For the purposes of promoting an understanding of the principles of the subject matter, reference will now be made to the embodiments illustrated in the drawings and specific language will be used to describe the same. It will nevertheless be understood that no limitation of the scope of the subject matter is thereby intended. Any alterations and further modifications in the described embodiments, and any further applications of the principles of the subject matter as described herein are contemplated as would normally occur to one skilled in the art to which the subject matter relates.

Overview

Fluid compressor systems are widely used in a variety of industries such as in construction, manufacturing, agriculture, energy production, etc. As fluid compressors compress a working fluid, heat is produced as a result of the pressure increase in the working fluid. Fluid compressors can have more than one compressor stage by having more than one air-end, where the working fluid is compressed several times in steps, or stages, to increase the discharge pressure. The second stage may be physically smaller than the primary stage, to accommodate the already compressed gas without reducing its pressure.

As each air-end on each stage further compresses the working fluid, it increases its pressure and its temperature. Intercoolers and aftercoolers are heat exchangers used to cool the working fluid after being compressed in each air-end. Heat exchangers include but are not limited to shell and tube heat exchangers, extended fin heat exchangers, double-pipe heat exchangers, helical-coil heat exchangers, and waste heat recovery units among others. Types of shell and tube heat exchangers include but are not limited to fixed tube sheet heat exchangers, U-tube heat exchangers, floating head heat exchangers, among others.

Intercoolers may accumulate dirt and debris build up over time, which may cause partial or total clogging of tubes within the intercoolers. As a consequence, the intercoolers do not run at their maximum efficiency and the temperature of the working fluid may be higher than desired prior to entering the next compression stage or air-end. Users may modulate water/coolant flow to the cooler in a way to lower the discharge temperature at each compression stage.

The present disclosure is directed to a fluid compression system having at least two compression stages, in other words, at least a first air-end and a second air-end, configured to compress a working fluid. The fluid compression system includes a first intercooler, a second intercooler, and an aftercooler configured to reduce the temperature of the working fluid after the working fluid is compressed by the first and second air-ends at each of the two compression stages, and a coolant circulation system having at least one throttle valve that regulates the flow of a coolant flowing through the coolant circulation system. The throttle valve modulates the coolant flow of the coolant circulation system to lower a desired air-end temperature of the fluid compression system.

The throttle valve for the coolant circulation system can be used with any type of device having a cooler or heat exchanger and should not be limited to the illustrative fluid compressor system shown in any of the accompanying figures. The term "working fluid" should be understood to include any compressible fluid medium that can be used in the fluid compressor system as disclosed herein. It should be understood that air is a typical working fluid, but different fluids or mixtures of fluid constituents can be used and remain within the teaching of the present disclosure. Therefore, terms such as working fluid, air, compressible gas, etc. can be used interchangeably in the present disclosure. For example, in some embodiments it is contemplated that ambient air, a hydrocarbon gaseous fuel including natural gas or propane, or inert gases including nitrogen or argon may be used as a primary working fluid.

The term "coolant" should be understood to include any fluid medium that can be used in the coolant circulation system as disclosed herein, where the fluid is used to reduce or regulate the temperature of the fluid compression system. It should be understood that water is a typical coolant, but different fluids or mixtures of fluid constituents can be used and remain within the teaching of the present disclosure. Therefore, terms such as water, coolant, heat-transfer fluid, refrigerant, etc. can be used interchangeably in the present disclosure. For example, in some embodiments it is contemplated that water, a liquid coolant mixture including water, corrosion inhibitors, and antifreeze, or liquid gases including liquid nitrogen, may be used as a coolant.

Detailed Description of Example Embodiments

Referring generally to FIGS. 1 through 6, a fluid compressor system 100 is shown. The fluid compressor system 100 includes a first air-end 101, a second air-end 102, a third air-end 103, a coolant circulation system 106 having a first intercooler 108 having a first front end 109A, and a second intercooler 110 having a second front end 109B. The coolant circulation system 106 includes a coolant collecting header 112 and a coolant supplying header 114. In embodiments, the fluid compressor system 100 further includes an aftercooler 118 in fluid connection with the coolant circulation system 106.

In example embodiments, the fluid compressor system 100 may include at least one motive source (not shown) driving the first air-end 101, the second air-end 102, and the third air-end 103. An inlet air filter filters an incoming compressible working fluid (e.g., air, gas, etc.) prior to the working fluid entering the first air-end 101. The motive source may be operable for driving the first air-end 101, the second air-end 102, and the third air-end 103 via a drive shaft. The motive source may be an electric motor, an internal combustion engine, a fluid-driven turbine, or the like.

In the example embodiment shown in FIGS. 1 through 6, the fluid compressor system 100 has three compression stages. However, in other embodiments, the fluid compression system 100 may have two compression stages, including a first air-end, a second air-end, and a coolant circulation system having one intercooler and one aftercooler. In other example embodiments, the fluid compressor system 100 may include more than three compression stages with the corresponding number of air-ends and intercoolers disposed, where the intercoolers are configured to cool a working fluid delivered by each corresponding air-end.

The first air-end 101 receives the working fluid and compresses the working fluid in a first stage compression process. This first stage compression process also increases the temperature of the working fluid. The first intercooler 108 is located downstream from the first air-end 101 and upstream from the second air-end 102. The first intercooler 108 cools down the working fluid delivered by the first air-end 101 prior to entering the second air-end 102. In embodiments, the fluid compressor system 100 includes a first interstage moisture separator (not shown) to separate moisture from the working fluid prior to entering the second air-end 102.

The second air-end 102 receives the working fluid and further compresses it, increasing its temperature. A second intercooler 110 receives the compressed working fluid from the second air-end 102 and cools it down prior to delivering the working fluid to the third air-end 103. In embodiments, the fluid compressor system 100 includes a second interstage moisture separator (not shown) to separate moisture from the working fluid prior to entering the third air-end 103.

The third air-end 103 receives the working fluid and further compresses it, increasing its temperature. An aftercooler 118 receives the compressed working fluid from the third air-end 103 and cools it down prior to discharging the compressed working fluid through a discharge outlet or delivering the compressed working fluid to a processing system for further processing.

In example embodiments (not shown) the fluid compressor system includes a temperature monitoring and control system for staged inlet temperatures. The temperature monitoring and control system may include a first air-end temperature sensor, a second air-end temperature sensor, a third air-end temperature sensor, and a fluid compressor system discharge temperature sensor. The first air-end temperature sensor, the second air-end temperature sensor, and the third air-end temperature sensor may each sense a temperature of the working fluid at the discharge of each corresponding compression stage.

Figure 3:
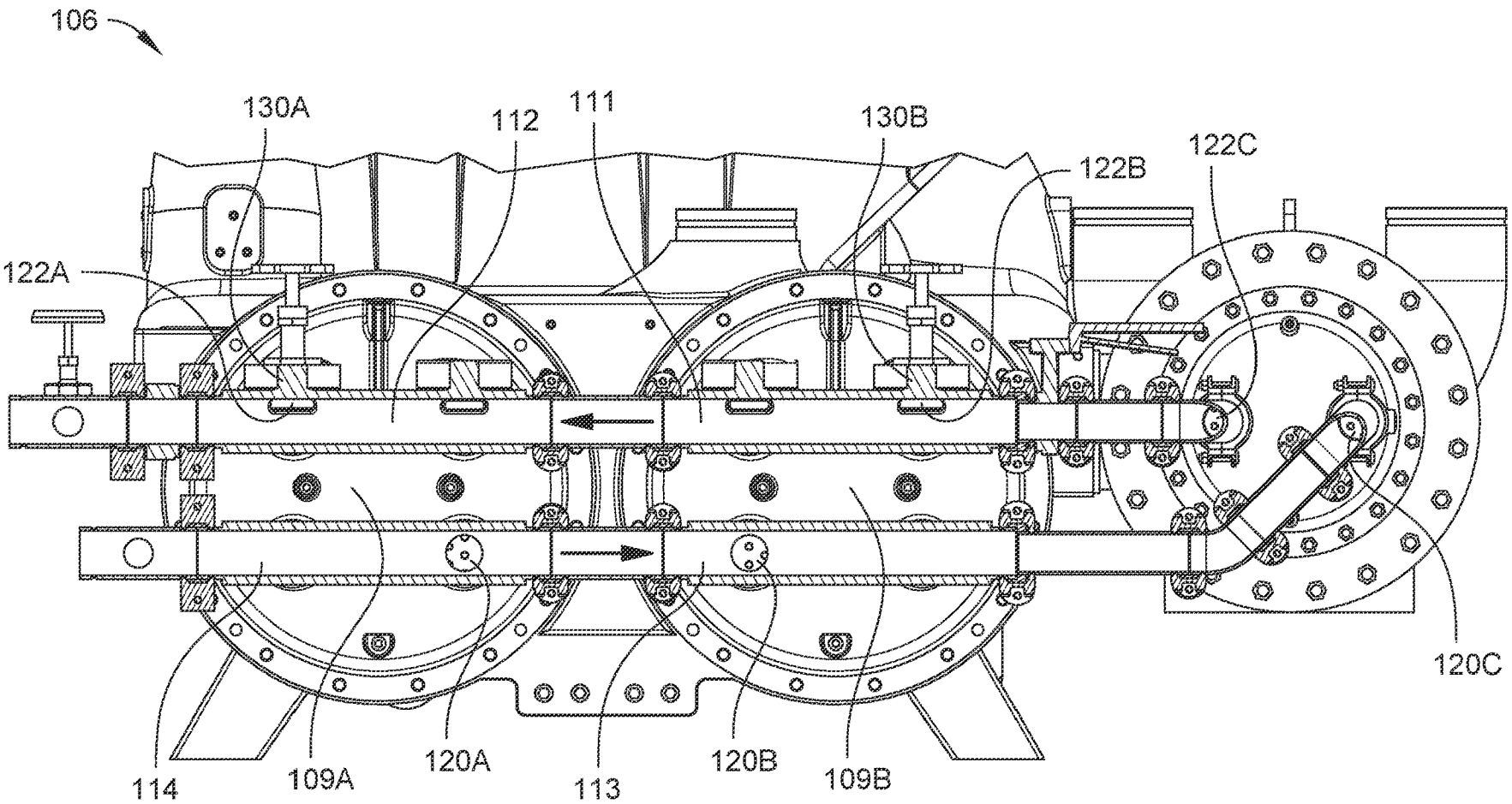
FIG. 3 is a cross-sectional front view of the coolant circulation system shown in FIG. 1, including a first throttle valve and a second throttle valve respectively connected to the first intercooler and the second intercooler in accordance with example embodiments of the present disclosure.

With respect to FIG. 3, an example embodiment of the coolant circulation system 106 is shown. The coolant circulation system 106 circulates a coolant to the first intercooler 108, the second intercooler 110, and the aftercooler 118. However, in embodiments having more than three compression stages, the coolant circulation system 106 circulates through each one of the respective intercoolers and aftercoolers of the fluid compression system 100.

The coolant circulation system 106 includes a coolant supplying header 114 and a coolant collecting header 112. The coolant supplying header 114 includes a main coolant supplying pipeline 113 that supplies a coolant flow to a first coolant inlet 120A at the first front end 109A of the first intercooler 108, a second coolant inlet 120B at the second front end 109B of the second intercooler 110, and a third coolant inlet 120C of the aftercooler 118. The coolant supplying header 114 connects the first intercooler 108, the second intercooler 110, and the aftercooler 118 in parallel with each other.

The coolant collecting header 112 includes a main coolant collecting pipeline 111 that aggregates the coolant flow exiting each one of the first intercooler 108, the second intercooler 110, and the aftercooler 118. The main coolant collecting header 112 is connected to a first coolant outlet 122A of the first intercooler 108, a second coolant outlet 122B of the second intercooler 110, and a third coolant outlet 122C of the aftercooler 118. The coolant collecting header 112 connects the first intercooler 108, the second intercooler 110, and the aftercooler 118 in parallel with each other.

The flow of coolant within the coolant circulation system 106 may be driven by a pump (not shown). As shown, the coolant flow circulating in the coolant supplying header 114 is split into a first flow stream, a second flow stream, and a third flow stream. The first flow stream passes into the first intercooler 108, where the working fluid delivered by the first air-end 101 is cooled. After splitting from the first flow stream, the second flow stream is directed to the second intercooler 110, where the working fluid delivered by the second air-end 102 is cooled. After splitting from the second flow stream, the third flow stream is directed to the aftercooler 118, where the working fluid delivered by the third air-end 103 is cooled. The first flow stream, second flow stream, and third flow stream merge back together into the same coolant flow stream in the coolant collecting header 112 after the heat exchanging process at each respective one of the first intercooler 108, the second intercooler 110 and the aftercooler 118.

Figure 4:
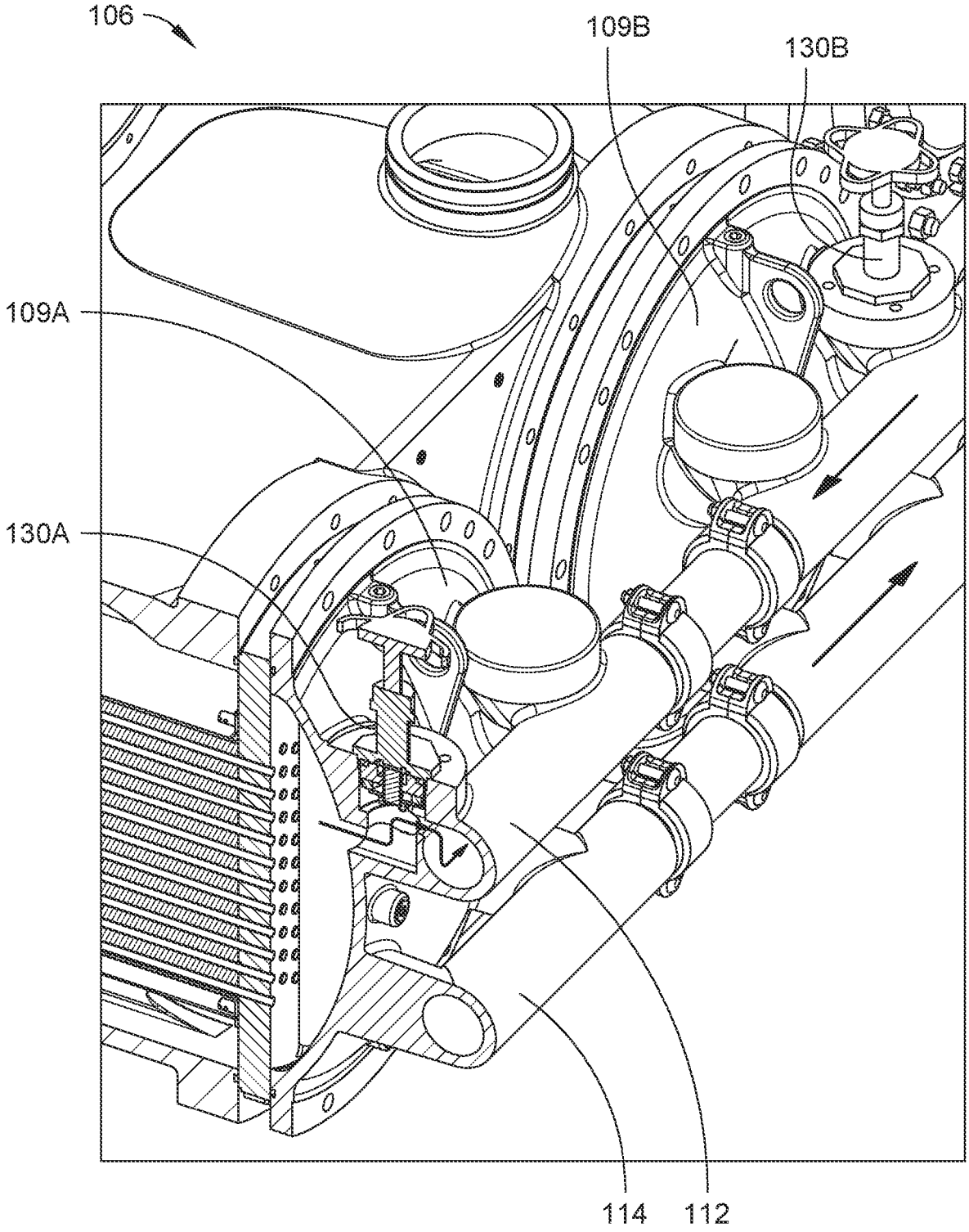
FIG. 4 is a perspective cross-sectional side view of the first throttle valve illustrated in FIG. 3, wherein the first throttle valve regulates a coolant flow of a coolant discharged by the first intercooler into the coolant collecting header, in accordance with example embodiments of the present disclosure.

Referring to FIGS. 1 and 4, a first throttle valve 130A is mounted to the first front end 109A of the first intercooler 108. The first throttle valve 130A regulates the coolant flow discharged by the first coolant outlet 122A prior to being collected into the coolant collecting header 112. A second throttle valve 130B is mounted to the second front end 109B of the second intercooler 110. The second throttle valve 130B regulates the coolant flow discharged by the second coolant outlet 122B prior to being collected into the coolant collecting header 112.

Figure 5:
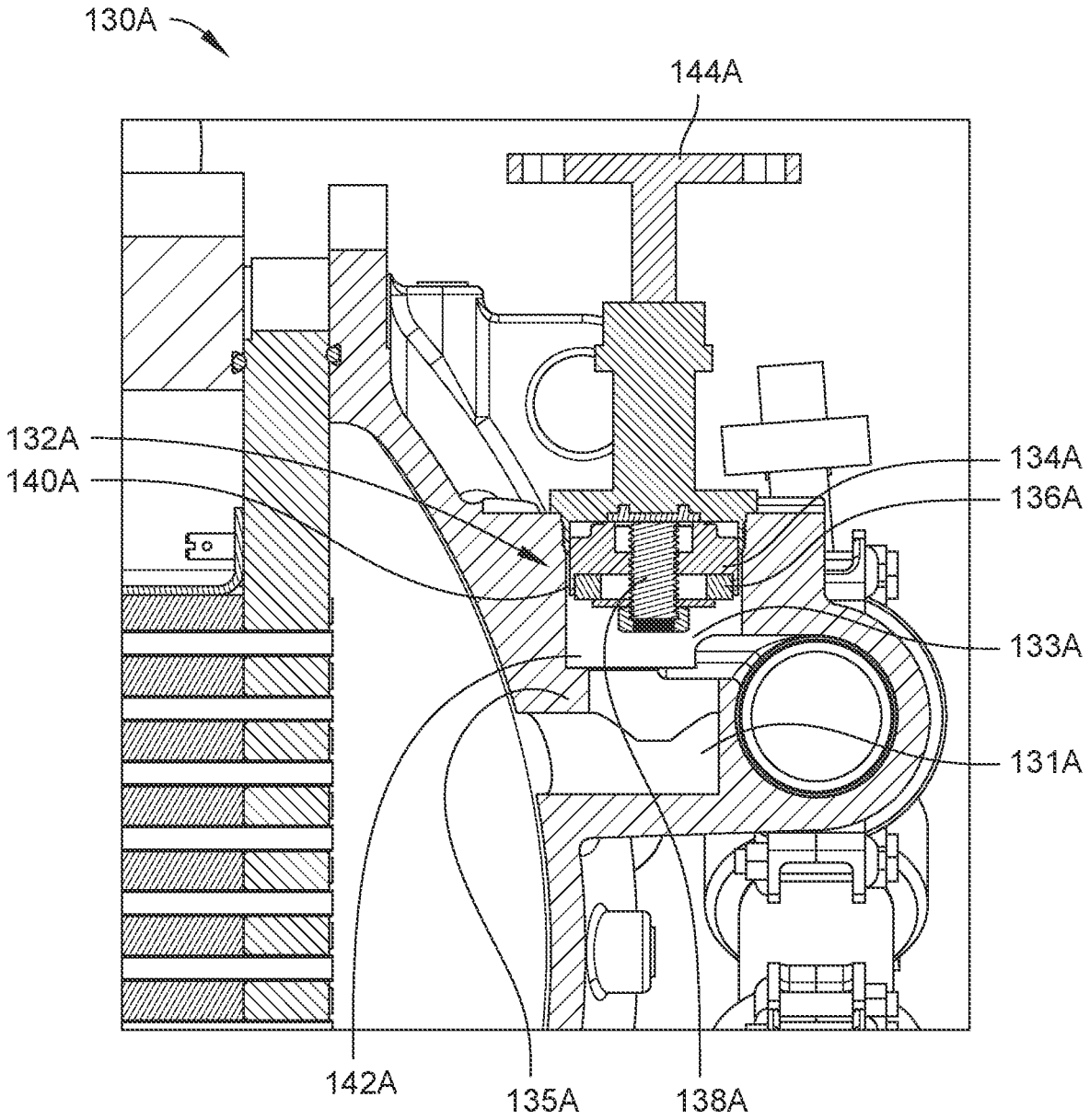
FIG. 5 is a cross-sectional side view of the first throttle valve shown in FIG. 3 in accordance with example embodiments of the present disclosure.
Figure 6:
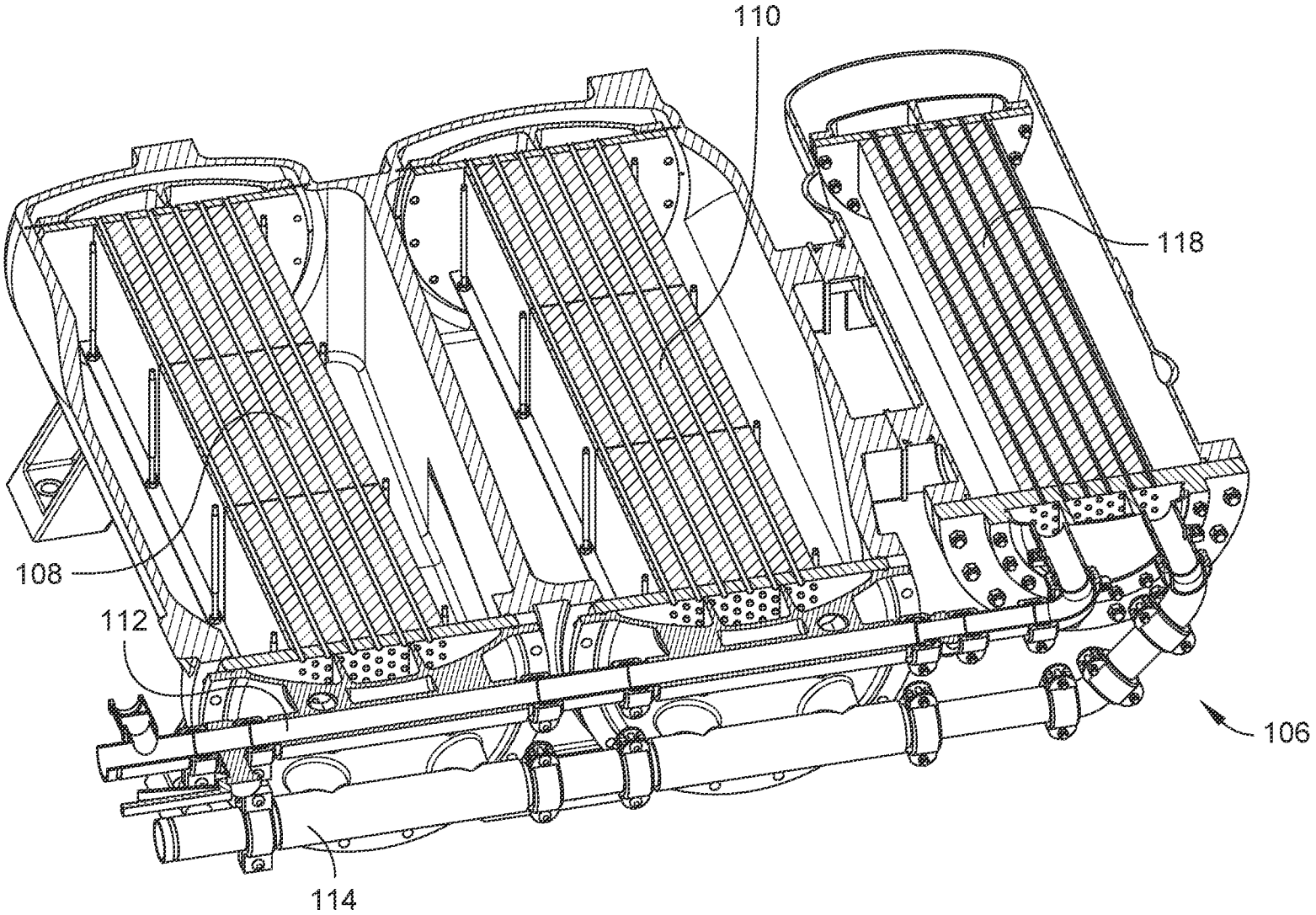
FIG. 6 is a cross-sectional top view of the fluid compressor system shown in FIG. 1, illustrating the first intercooler, the second intercooler, and an aftercooler in accordance with example embodiments of the present disclosure.

In the embodiment shown in FIG. 5, the first throttle valve 130A includes valve body 132A, a bonnet 134A, a seating element 136A (e.g., plug, disk, etc.), a stem 138A, a cage 140A, a seat 142A, and a handwheel 144A. The handwheel 144A may be rotated between an open position and a closed position, with a definite number of positions between the open position and the closed position. At the open position shown in FIG. 5, the coolant flow is free to exit the first intercooler 108 into the coolant collecting header 112 through the first coolant outlet 122A. As the handwheel 144A is rotated, the stem 138A is threaded into the bonnet 134A and the seating element 136A starts restricting the coolant flow exiting the first intercooler 108. In the fully closed position (not shown), the seating element 136A is fully seated into the seat 142A, and the first coolant outlet 122A is fully shutoff. The first throttle valve 130A adjusts the rate at which the coolant flows out of the first intercooler 108 back into the coolant collecting header 112 of the coolant circulation system 106. It should be understood that the second throttle valve 130B includes a respective one of each of the same components of the first throttle valve 130A. In embodiments, the first throttle valve 130A and the second throttle valve 130B are globe valves. In other embodiments, the first throttle valve 130A and the second throttle valve 130B may be ball valves, gate valves, butterfly valves, needle valves, pinch valves, diaphragm valves, among others.

The first throttle valve 130A and the second throttle valve 130B help the fluid compressor system 100 run at a higher efficiency and may help a user to direct the coolant flow in an efficient way. For example, by being able to regulate the coolant flow exiting the first intercooler 108 and/or the second intercooler 110, the coolant flow from the first intercooler 108 and/or the second intercooler 110 may be restricted and directed to another element of the coolant circulation system 106 that may require a higher coolant flow to operate.

In embodiments, if one of the air-end temperature sensors of the temperature monitoring and control system senses that an inlet or outlet temperature from one or more of the air-ends is too high, the coolant flow can be partially restricted from one of the intercoolers and directed to the respective intercoolers that cool the working flow of the mentioned air-ends. For example, if the first intercooler 108 is discharging the working fluid at a temperature that is higher than a desired predetermined temperature range, a user may fully open the first throttle valve 130A and partially close the second throttle valve 130B to flow the coolant fluid flow of the first intercooler 108 at a higher coolant fluid flow rate than the rest of the coolant circulation system 106.

In example embodiments (not shown), the first throttle valve 130A is connected to the first coolant inlet 120A and the second throttle valve 130B is connected to the second coolant inlet 120B. In such embodiments, the throttle valve regulates the coolant flow supplied by the coolant supplying header 114 into each one of the first intercooler 108 and the second intercooler 110. In other embodiments (not shown), a third throttle valve may be disposed at the third coolant outlet 122C or at the third coolant inlet 120C of the aftercooler 118.

In example embodiments, the coolant circulation system 106 is in fluid communication with intercoolers that cool the working fluid of the fluid compressor system 100 and oil coolers (not shown) that cool an oil flow provided to the compression stages (for example, in contact-cooled air-ends) and other rotating elements of the fluid compressor system. Each of the oil coolers may include a respective coolant inlet in fluid communication with the coolant supplying header and a coolant outlet in fluid communication with the coolant collecting header of the coolant circulation system 106.

In the embodiment shown, the first throttle valve 130A and the second throttle valve 130B are manually operated. However, in other embodiments (not shown), the throttle valves may be automatic throttle valves. For example, the throttle valves may be pneumatic throttle valves, electrical throttle valves, among other automatic throttle valves. The automatic throttle valves may be remotely controlled by a control system or programmed to actuate at specific hours of the day. The control system controlling the first throttle valve 130A and the second throttle valve 130B may be in communication with the temperature monitoring system monitoring the first air-end temperature sensor, the second air-end temperature sensor, the the third air-end temperature sensor, and the fluid compressor system discharge temperature sensor.

In implementations, the coolant circulating system 106 may be retrofitted into existing fluid compressor systems and heat exchanger systems. The application of a throttle valve in the coolant circulating system 106 is not limited to fluid compression systems, as any equipment having a heat exchanging application where a coolant circulation system supplies a coolant flow to several cooling elements may benefit from the increased efficiency as a result of the coolant circulation system having at least one throttle valve. Other applications include, but are not limited to, HVAC systems, refrigeration systems, gas turbines, petrochemical plants, etc.

While the subject matter has been illustrated and described in detail in the drawings and foregoing description, the same is to be considered as illustrative and not restrictive in character. In reading the claims, it is intended that when words such as "a," "an," or "at least one" are used there is no intention to limit the claim to only one item unless specifically stated to the contrary in the claim. Unless specified or limited otherwise, the terms "mounted," "connected," and "coupled" and variations thereof are used broadly and encompass both direct and indirect mountings, connections, supports, and couplings. Further, "connected" and "coupled" are not restricted to physical or mechanical connections or couplings.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A fluid compressor system configured to supply a compressed working fluid comprising:

a first air-end configured to compress the working fluid;

a second air-end configured to further compress the working fluid discharged by the first air-end;

a third air-end configured to further compress the working fluid discharged by the second air-end;

a first intercooler located between the first air-end and the second air-end and having a first coolant inlet and a first coolant outlet, the first intercooler configured to cool the working fluid discharged by the first air-end before entering the second air-end;

a second intercooler located downstream from the second air-end and having a second coolant inlet and a second coolant outlet, the second intercooler configured to cool the working fluid discharged by the second air-end;

an aftercooler configured to cool the working fluid discharged by the third air-end; and a coolant circulation system having a coolant supplying header and a coolant collecting header, the coolant supplying header configured to supply the coolant to the first intercooler, the second intercooler, and the aftercooler, and the coolant collecting header configured to collect the coolant from the first intercooler, the second intercooler, and the aftercooler;

wherein the first intercooler, the second intercooler, and the aftercooler connected in parallel with each other, and wherein the coolant circulation system includes a first throttle valve between the first coolant outlet and the coolant collecting header, the first throttle valve configured to regulate a coolant flow discharged by the first intercooler.

2. The fluid compressor system of claim 1, wherein the coolant circulation system includes a second throttle valve between the second coolant outlet and the coolant collecting header, the second throttle valve configured to regulate a coolant flow discharged by the second intercooler.

3. The fluid compressor system of claim 2, wherein a third coolant inlet is in fluid communication with the coolant supplying header, and a third coolant outlet is in fluid communication with the coolant collecting header.

4. The fluid compressor system of claim 1, wherein the first throttle valve of the first intercooler is at least partially closed to increase the rate of coolant fluid flow flowing to at least one of the second intercooler or the aftercooler when the discharged temperature of the at least one of the second intercooler or the aftercooler exceeds a desired temperature range.

5. The fluid compressor system of claim 2, wherein the second throttle valve of the second intercooler is at least partially closed to increase the rate of coolant fluid flow flowing to the aftercooler when the discharged temperature of the aftercooler exceeds a desired temperature range.

6. The fluid compressor system of claim 2, further comprising an oil cooler configured to supply oil to the first air-end and the second air-end, the oil cooler connected to the coolant circulation system and having a fourth coolant inlet in fluid communication with the coolant supplying header, a fourth coolant outlet in fluid communication with the coolant collecting header, and a fourth throttle valve connected between the third coolant outlet and the coolant collecting header, the fourth throttle valve configured to modulate a coolant flow discharged by the oil cooler.

7. The fluid compressor system of claim 2, wherein the first throttle valve and the second throttle valve are globe valves.

8. A fluid compressor system configured to supply a compressed working fluid comprising:

a first air-end configured to compress the working fluid;

a second air-end configured to further compress the working fluid discharged by the first air-end;

a third air-end configured to further compress the working fluid discharged by the second air-end;

a first intercooler located between the first air-end and the second air-end and having a first coolant inlet and a first coolant outlet, the first intercooler configured to cool the working fluid discharged by the first air-end before entering the second air-end;

a second intercooler located downstream from the second air-end and having a second coolant inlet and a second coolant outlet, the second intercooler configured to cool the working fluid discharged by the second air-end;

an aftercooler configured to cool the working fluid discharged by the third air-end; and a coolant circulation system having a coolant supplying header and a coolant collecting header, the coolant supplying header configured to supply the coolant to the first intercooler, the second intercooler, and the aftercooler, and the coolant collecting header configured to collect the coolant from the first intercooler, the second intercooler, and the aftercooler;

wherein the coolant circulation system includes a first throttle valve between the first coolant outlet and the coolant collecting header and a second throttle valve between the second coolant outlet and the coolant collecting header, the first throttle valve and the second throttle valve configured to respectively regulate a coolant flow discharged by the first intercooler and the second intercooler.

9. The fluid compressor system of claim 8, wherein first intercooler, the second intercooler, and the aftercooler are connected in parallel through the coolant supplying header and the coolant collecting header.

10. The fluid compressor system of claim 8, wherein the first throttle valve of the first intercooler is at least partially closed to increase the rate of coolant fluid flow flowing to at least one of the second intercooler or the aftercooler when the discharged temperature of the at least one of the second intercooler or the aftercooler exceeds a desired temperature range.

11. The fluid compressor system of claim 8, wherein the second throttle valve of the second intercooler is at least partially closed to increase the rate of coolant fluid flow flowing to the aftercooler when the discharged temperature of the aftercooler exceeds a desired temperature range.

12. The fluid compressor system of claim 8, wherein the first throttle valve and the second throttle valve are globe valves.

13. A coolant circulation system for supplying a coolant flow comprising:

a coolant supplying header configured to supply the coolant flow to a first cooling element, a second cooling element, and a third cooling element;

a coolant collecting header configured to collect the coolant flow from the first cooling element, the second cooling element, and the third cooling element;

a first throttle valve coupled between the first cooling element and the coolant collecting header; and a second throttle valve coupled between the second cooling element and the coolant collecting header, wherein the first throttle valve and the second throttle valve are configured to respectively regulate a coolant flow discharged by the first cooling element and the second cooling element; and where the first cooling element, the second cooling element, and the third cooling element are connected in parallel through the coolant supplying header and the coolant collecting header.

14. The coolant circulation system of claim 13, wherein the first throttle valve of the first cooling element is at least partially closed to increase the rate of coolant fluid flow flowing to at least one of the second cooling element or the third cooling element when the discharged temperature of the at least one of the second cooling element or the third cooling element exceeds a desired temperature range.

15. The coolant circulation system of claim 14, wherein the second throttle valve of the second cooling element is at least partially closed to increase the rate of coolant fluid flow flowing to the third cooling element when the discharged temperature of the third cooling element exceeds a desired temperature range.

16. The coolant circulation system of claim 15, wherein at least one of the first throttle valve or the second throttle valve is fully closed to increase the rate of coolant fluid flow flowing to the third cooling element when the discharged temperature of the third cooling element exceeds a desired temperature range.

17. The coolant circulation system of claim 13, wherein the first throttle valve and the second throttle valve are globe valves.

* * * * *